US005237792A

United States Patent [19]

Oberman et al.

[11] Patent Number: 5,237,792

[45] Date of Patent: Aug. 24, 1993

[54] COMPACT TRUSS SYSTEM

[75] Inventors: Dave Oberman, Palos Verdes Estates; Christopher L. Teuber, Venice, both of Calif.

[73] Assignee: Obie's Lighting Productions, Inc., Torrance, Calif.

[21] Appl. No.: 947,161

[22] Filed: Sep. 18, 1992

[51] Int. Cl.[5] ..... E04H 12/18

[52] U.S. Cl. ..... 52/645; 52/690; 182/179

[58] Field of Search ..... 52/645, 646, 638, 633, 52/126.1, 126.6, 690, 693, 28; 362/285; 182/179

[56] References Cited

U.S. PATENT DOCUMENTS 4,862,336 8/1989 Richardson et al. ..... 52/645 X 5,008,967 4/1991 Barrios et al. ..... 52/638 X

*Primary Examiner*—Carl D. Friedman

*Assistant Examiner*—Creighton Smith

[57] ABSTRACT

A truss system for supporting stage lights or other components having a strong rigid frame and a vertically adjustable deck from which the components are highly accessible. The system may be connected to other systems either collinearly or in angled configurations. Caster legs are retractable and the deck is vertically adjustable in response to the components used and/or the geometry of the venue. The deck is cushioned against shock and vibration by interposing coiled cable shocks between the frame and deck.

22 Claims, 13 Drawing Sheets

COMPACT TRUSS SYSTEM

BACKGROUND OF THE INVENTION

1. Field of the Invention

This invention relates generally to support structures, and specifically to a compact truss system for supporting lighting and scenery for the musical, theatrical, industrial, television and motion picture fields.

2. Description of the Related Art

Concert entertainers, touring theatrical troupes, industrial shows, and other groups or entities from the entertainment industry often schedule extended tours consisting of a small number of performances in each of a large number of cities. Immediately after the final performance at a venue is completed, the sets and ancillary equipment used during the show are struck, repackaged for transport, and placed on board moving vans which then drive to the next venue where the sets and equipment are again deployed. In order to compete effectively for consumer dollars by meeting constantly growing expectations by the entertainment seeking public for more elaborate spectacles, shows are increasingly making use of sophisticated lighting systems and frequent changes of scenic backdrops. For example, the direction, intensity and color of each of a plurality of spotlights or other luminaires can be individually controlled by a computer driving a servomechanism to which each light is attached so as to orchestrate complex dynamic lighting effects.

As the sophistication and complexity of stage equipment, particularly lighting systems, for touring shows have increased, the time required to set up and tear down equipment, the number and skill level of stage hands required, and the susceptibility to damage of fragile components to setting up and tearing down, as well as to rolling on and off the transport vehicles, all have become increasingly important factors impacting tour profitability. Equipment broken or jarred so as to be inoperable must be repaired or replaced in time for the next performance. Equipment which is difficult to assemble, disassemble and align can require training and maintaining an unacceptably large and relatively well paid stage crew. After equipment has been erected at a new location and hoisted above the stage, there is likely to be continuing need for the crew to access in-place components for fine-tuning. Set geometries may need to be reconfigured to accommodate the constraints of smaller theaters and convention halls. There is thus a tradeoff between recurring costs for operation and maintenance, and the simplicity of assembly, maintenance and tear down. The movie and television industries face exactly the same concerns.

U.S. Pat. No. 4,862,336 to Richardson et al. discloses a truss unit for supporting a plurality of stage lights which allows each light to direct a beam about an arc of 360° without beam interference by the truss unit, and which protectively encases the stage lights during transportation. U.S. Pat. Nos. 4,392,187 to Bornhorst and 4,512,117 to Lange also dislose truss units which support stage lights but which require either removing the lights from the units prior to transportation or adding protective structures. However, none of these units provide for all of the following: quick and easy adjustment to the height of equipment components suspended therefrom; quick and easy assembly and disassembly; accessing components for replacement or manual adjustment; raising and lowering components easily, by individual unit, when multiple units are connected to form a single structure; joining units at angles to form non-linear truss structures; requiring a minimal clearance in operation protecting mounted components from shock when a unit is subjected to severe jarring or otherwise is roughly handled or transported; or the option of transporting in a horizontal or vertical disposition, thereby maximizing available trunk space.

OBJECTS OF THE INVENTION

Accordingly, it is an object of the present invention to provide a truss system capable of linking at either end with another such unit, either rectilinearly or so as to form an acute, right, or obtuse angle.

Another object of the invention is to provide a deck within the truss system whose height can be varied by simply sliding vertically over a wide range.

A further object of the invention is to provide a deck enabling attachment of lighting, scenic and other equipment.

Yet another object of the invention is to provide a system which directs loading forces to the stronger parts of the system.

A still further object of the invention is to provide a deck facilitating access by workers to components needing replacement or adjustment, both before and after hoisting the unit.

Another object of the invention is to maintain rigidity of a system by restraining lateral movement of the lateral members after the system is hoisted.

Yet another object of the invention is to have a system that operates with minimal clearances.

A further object of the invention is to provide mobility so that a system may be readily moved between a van and the interior of a theater, arena, convention hall or other location.

Another object of the invention is to provide a system which is compact and which can be stored or transported in a vertical disposition.

Yet a further object of the invention is to minimize the shook and vibration environments of components attached to the deck when the system is in transit, being erected, or being repackaged for storage.

Still another object of the invention is to provide a system that can be quickly assembled and disassembled so as to minimize labor costs.

One more object of the invention is to provide a system that is relatively simple and inexpensive, yet reliable.

Other objects of the invention will become evident when the following description is considered with the accompanying drawings.

SUMMARY OF THE INVENTION

The inadequacies of the prior art have been resolved by the present invention which is a compact truss system that is simple, quick and easy to use. In its broadest sense, the system comprises a platform deck, opposed first and second lateral members, means for guiding the platform deck vertically relative to the lateral members, and means for locking the preselected vertical position of the deck. In more detail, a truss system of the present invention comprises: a unitary cage-shaped frame having opposed first and second vertical sides each constructed of a pair of longitudinally extending tubular side beams, a pair of vertical tubular end beams, and a vertical tubular center beam, connected by a plurality of tubular cross beams; a pair of U-shaped end members each comprising a horizontal tubular beam and a pair of vertical tubular beams; a vertically adjustable pair of horizontal and coplanar platform deck sections separated by a longitudinal medial space and perforated to enable attachment of equipment components; a retractable tubular leg at each of four corners which is welded at its downward end to a mounting plate to which is attached a caster; and a plurality of shock mounts interposed between the deck sections and frame.

The deck sections are attached at each end to a common tubular member with end-plates, and are attached at their midpoint to a transverse bar beam. A collar in which the leg is slidably disposed and a block-shaped guide for attaching an end-plate to the frame are welded to each of four corner end-plates. A block-shaped guide for attaching the transverse bar beam to the frame is also welded to each end of the beam. The deck height is changed by removing plungers which attach each guide to a vertical T-bar containing spaced holes and welded to the interior face of each of the four vertical tubular end beams and to the two center beams, and reinserting the plungers in appropriate holes after the deck sections are moved to the new position. Similarly, the position of a leg with respect to its collar is changed by removing a plunger passing through the collar and through one of a set of spaced punched holes in the leg, repositioning the leg so that an appropriate punched hole lines up with the collar, and reinserting the plunger.

The bottom of the rectangular cage frame may be constructed of a pair of longitudinally extending tubular side beams and a pair of tubular end beams orthogonal and welded to the side beams so as to form four right-angle corners. When the four legs of the unit are fully retracted, each tubular corner mates closely with and is captured by a concave recess on the upper surface of the mounting plate to which the leg is welded. When a truss system is being rolled on or pivoted about its casters, the resulting shock loading on the casters is dissipated from the beam corner-recess interfaces along the horizontal tubular beams so that equipment components mounted from the deck are minimally perturbed.

A tubular beam parallel to the horizontal tubular end beam of each U-shaped end member and welded at its ends to the vertical end beams serves to stiffen the end members. A channel segment welded to the two lateral beams reinforces stiffening and also can be used by a worker for gripping or kneeling on the truss. An advantage of this "goal post" construction is that a top bar, which would restrict installation of cabling and movement of workers between connected units, is unnecessary.

During transport, a protective configuration is used wherein the legs are fully retracted so that the cage defined by the sides and ends fully encloses and protects components suspended from the deck sections. A U-shaped cradle, attached at each end to a cradle mounting bracket, positioned under and parallel to each deck section and fitting closely between the channel segments provides additional protection to the suspended components. Prior to transport, the cradle mounting brackets are bolted to the rectangular end-plates, and the U-shaped cradles are bolted or latched to the cradle mounting brackets. The cradles and cradle mounting brackets are removed after a unit arrives at its destination.

Coiled cable shock mounts ma be used to isolate the deck sections and equipment suspended therefrom from shock and vibration. A plurality of shock mounts are interposed between the end-plates and deck section ends and between the transverse bar beam and deck sections. A plurality of shock mounts are also interposed between the U-shaped cradles and channel sections.

A multi-unit truss configuration is assembled on stage by first aligning in close proximity several units, each in the transport configuration. The units may be connected in a linear arrangement directly, one to another. Or, a U-shaped frame bracket may be bolted to each U-shaped end member which is to be connected to the end member of another truss unit. The angle formed by each pair of units may be maintained by a tie-bar locked into position on the U-shaped frame bracket.

After the truss units are joined together in a desired configuration and each platform deck is positioned at or near the bottom of its range of vertical adjustment, the cages are raised in tandem until all legs are fully extended, their casters remaining in contact with the ground. An adjustable brace at the center of each deck section is locked into position so as to rigidly maintain the vertical alignment of the lateral members once the structure is hoisted. Raising the cages fully exposes all equipment suspended from the underside of the deck sections so that individual components can easily be attached, removed or repositioned by workers who can remain standing on the stage or ground.

After equipment refurbishment or adjustment is completed, the multi-unit structure is raised several feet above the stage or ground by a plurality of hoists each connected to a lift bar which is connected by span cables attached to the vertical sides. The legs are retracted and the height of each platform deck may be adjusted and the location of components fine-tuned. The system may then be hoisted to its operational height. The system may be easily adjusted thereafter should it be desired.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
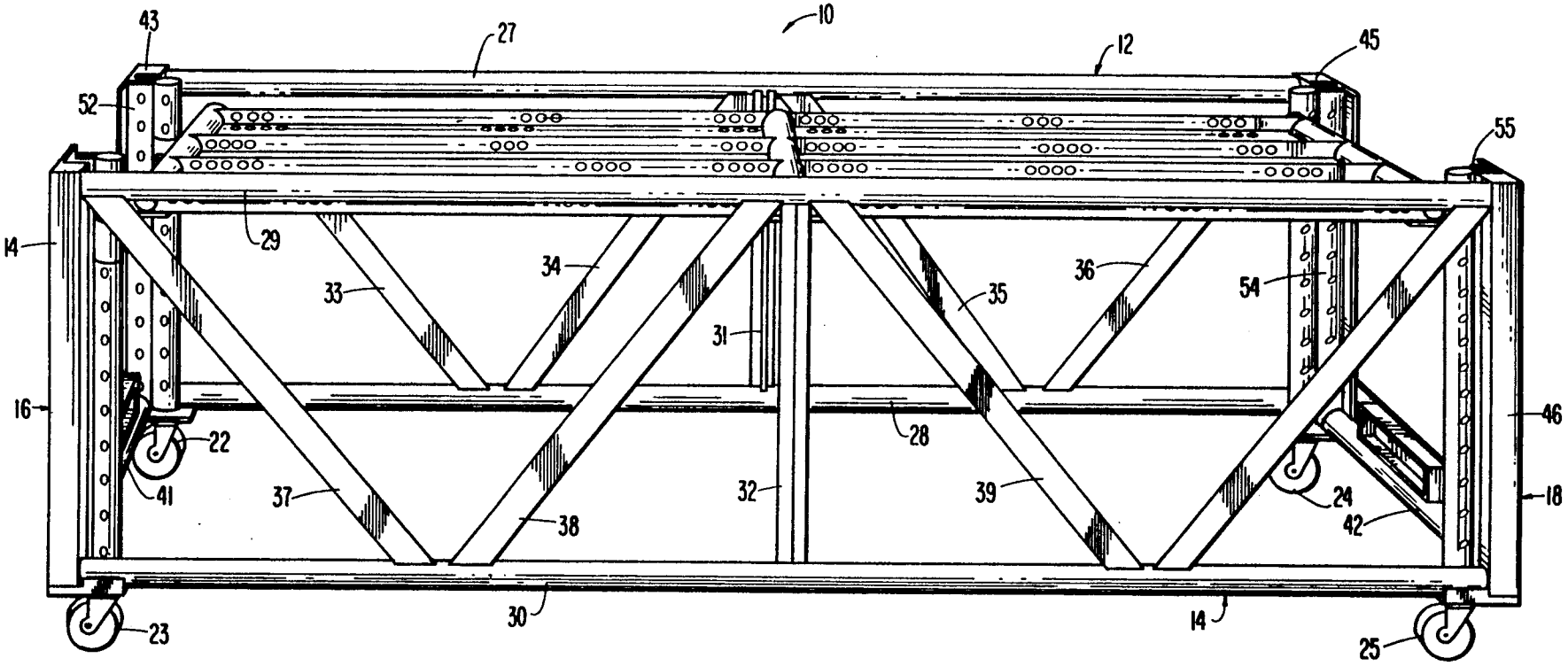
FIG. 1 is a perspective view of a preferred embodiment, with the deck fully raised and the legs fully retracted.

While the present invention is open to various modifications and alternative constructions, the preferred embodiment shown in the drawings will be described herein in detail. It is to be understood, however, there is no intention to limit the invention to the particular form disclosed. On the contrary, the intention is to cover all modifications, equivalences and alternative constructions falling within the spirit and scope of the invention a expressed in the appended claims.

Figures 2, 6:
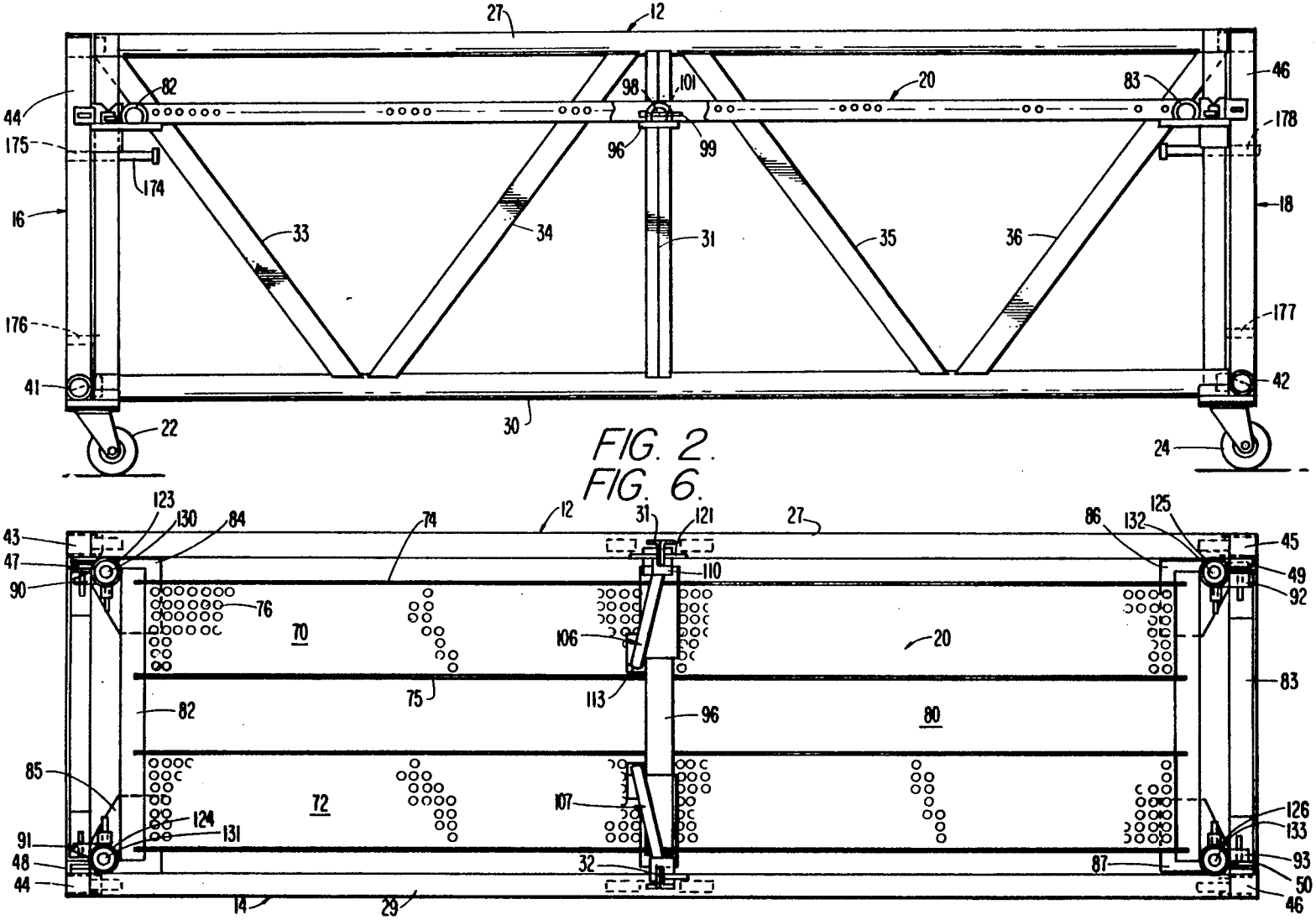
FIG. 2 is a partially broken away cross-section side elevational view with the deck at an intermediate position.
FIG. 6 is a top plan view of the preferred embodiment and with the adjustable deck section braces in-place.

The simplicity and reliability of the invention may best be appreciated by considering FIGS. 1 and 2. A truss system 10 includes a frame having opposed first and second lateral members 12 and 14, and opposed first and second U-shaped end members 16 and 18. The unit also includes a movable horizontal platform deck 20, and a plurality of casters 22, 23, 24 and 25. The lateral members 12 and 14 are each, respectively, constructed of a pair of top and bottom horizontal, longitudinally extending round tubular beams 27, 28 and 29, 30, vertical bar beams 31, 32, each of which may consist of two angle irons back-to-back or an extension connecting, respectively, the beams 27, 28 and 29, 30, and two sets of four rectangular tubular crossbeams 33, 34, 35, 36 and 37, 38, 39, 40 which are obliquely directed and which connect their respective longitudinal beams 27, 28 and 29, 30. FIG. 1 shows the truss unit 10 in its transportation configuration or mode where the deck 20 is positioned near the vertical top of the frame, generally in the plane defined by the horizontal beams 27, 29 so that the lateral members 12 and 14 and the end members 16 and 18 form a cage-like structure fully enclosing lighting and/or other equipment (shown in FIG. 12 but not shown in FIGS. 1 and 2) suspended from the deck 20. In FIG. 2, the deck 20 is shown in a slightly lowered vertical position relative to the lateral and end members.

Figure 3:
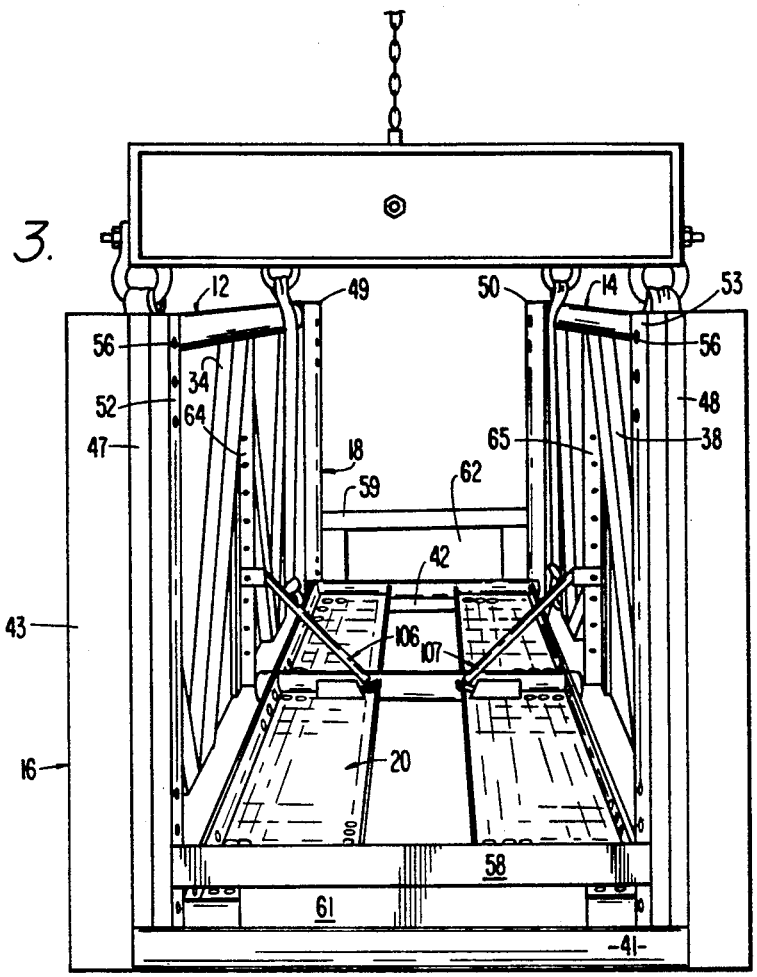
FIG. 3 is a perspective view of the interior of the preferred embodiment, with the deck fully lowered and the legs fully retracted.
Figure 4:
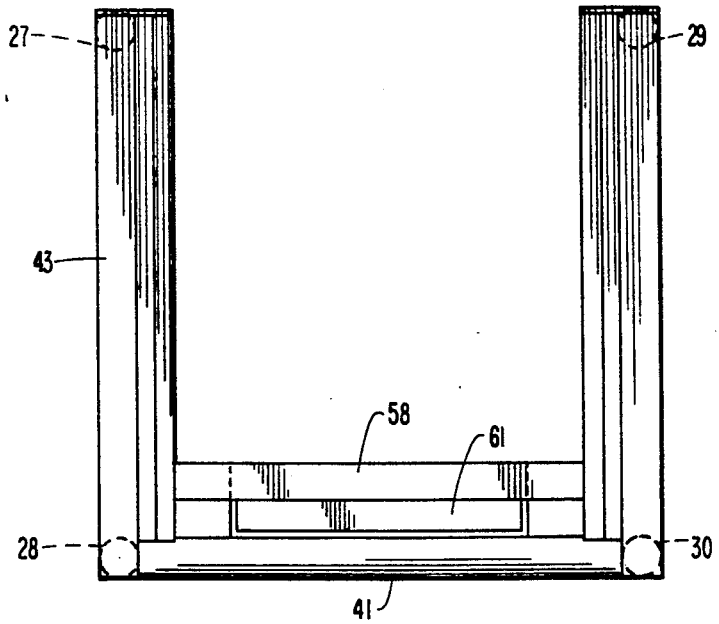
FIG. 4 is an elevational view of the U-shaped end member.

With additional reference to FIGS. 3 and 4, the simplicity, reliability and efficiency of the unit are emphasized. The U-shaped end members 16 and 18 include, respectively, a horizontal round tubular beam 41, 42 and a pair of vertical rectangular tubular beams 43, 44 and 45, 46, (see FIG. 1), to which are attached support members, such as a pair of "T"-shaped beams 47, 48 and 49, 50, each having a central flange 52, 53, 54, 55, respectively, with a multiplicity of spaced holes 56. A lateral reinforcing bar 58 extending parallel to the beam 41 is attached to the beams 47, 48 and serves to stiffen the end member 16; likewise, a lateral reinforcing bar 59 extending parallel to the beam 42 is attached to the beams 49, 50 and stiffens the end member 18. A pair of open box-shaped members 61, 62 attached, respectively, to the beam 41 and bar 58, and to the beam 42 and bar 59, reinforce stiffening of the end members 16 and 18, respectively, and also provide a handgrip, a step surface, and a storage chamber.

The deck 20 in FIG. 3 is shown in its lower position relative to the lateral and the end members. As will be explained in more detail later, the deck has the ability to slide vertically relative to the lateral and end members and thereby allow easy and efficient adjustment with a minimum of clearance required.

Figure 5:
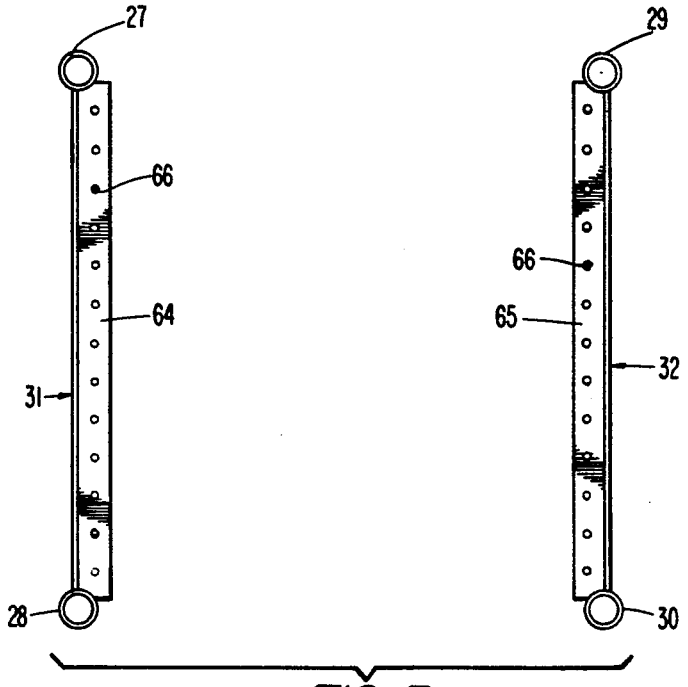
FIG. 5 is an elevational view of the center T-bar section.

Referring to FIGS. 3 and 5, there is shown the generally mid-positioned vertical bar beams 31, 32, each including, respectively, a central flange 64, 65 with a multiplicity of spaced holes 66.

The platform with facilitated access to suspended components is best appreciated by reference to FIG. 6 which shows the deck 20 including two parallel rectangularly shaped planar deck sections 70 and 72 with upwardly bent longitudinal edges, for example, edges 74 and 75 of section 70, each section containing a multiplicity of holes 76. The sections are separated by a space 80 which enables a worker kneeling on one or both of the deck sections 70 or 72 to access equipment attached to the underside of the deck 20, such as the lights shown in FIG. 12. The deck sections 70 and 72 are attached at each end to rectangular tubular support beams 82, 83, to which are attached, respectively, pairs of mounting plates 84, 85 and 86, 87.

Figure 7:
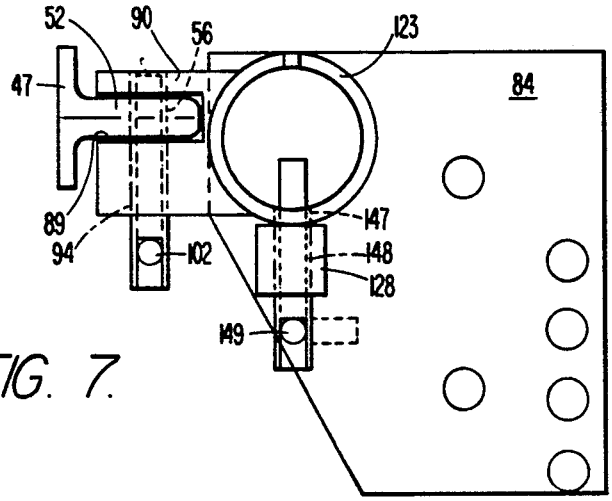
FIG. 7 is an enlarged top plan view of the deck section-to-frame attachment flange, the slidably adjustable leg socket, and associated mounting plate.
Figure 10:
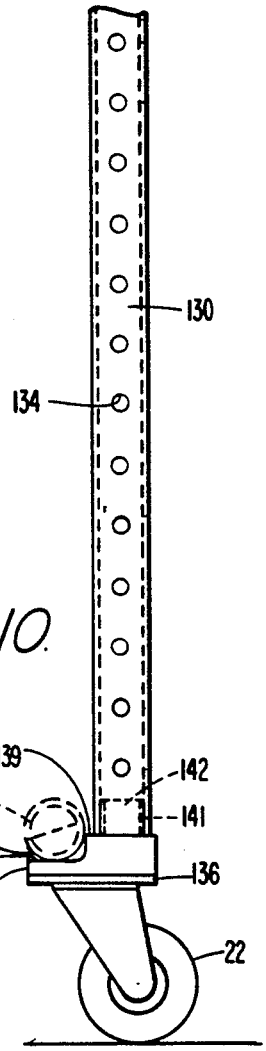
FIG. 10 is an elevational view of the leg, caster mounting plate and caster.

As best shown in FIG. 7, guiding means including the four mounting plates 84, 85, 86, 87 supports other elements of the guiding means including, respectively, block-shaped guides 90, 91, 92, 93 (see also FIG. 6). The other portion of the guiding means is, respectively, the T-shaped beams 47, 48, 49, 50 with the central flanges 52, 53, 54, 55. As seen in FIG. 7, the guide 90 is welded to the plate 84 and has a slot 89 to receive the flange 52 of the beam 47.

Referring again to FIGS. 2 and 6, the adjustability of the deck may be appreciated. The deck sections 70 and 72 are attached to and bisected by a transverse beam 96. Attached at each end of the beam 96 is a portion of a guiding means, such as block-shaped guide 98. The other portions of the guiding means are the beams 31, 32, each with the central flange 64, 65.

Locking means are provided to maintain the deck at the level selected. The locking means includes spring-loaded plungers and holes in the block-shaped guides and in the central flanges of the T-shaped beams. For example, as shown in FIG. 7, there is a hole 56 in the flange 52 and a hole 94 in the guide 90. A plunger 102 passes through the aligned holes to provide a lock. The same structure of block-shaped guide, central flange, aligned holes and a plunger also exists at the ends of the transverse beam 96 to guide and lock the center portion of the deck sections 70 and 72.

In more detail, the deck sections 70 and 72 are fixed in position at a preselected and adjustable vertical height by aligning the holes 94 in the block guides 90, 91, 92, 93 on the mounting plates 84, 85, 86, 87 and the holes 56 of the flanges 52, 53, 54, 55. In a like manner the holes in the block guides at each end of the beam 96 align with the holes in the flanges 64, 65. Then locking is accomplished by the use of spring-loaded plungers such as plunger 102. The plungers are fully retractable, quick release plungers, some forms of which are available commercially from Vlier Corporation of Burbank, Calif.

Where used here, the word "attached" means that the two parts referred to, usually of aluminum material, are welded as this form of attachment is preferred. However, other forms of attachment may be suitable, consistent with minimizing weight and expense.

Figure 8:
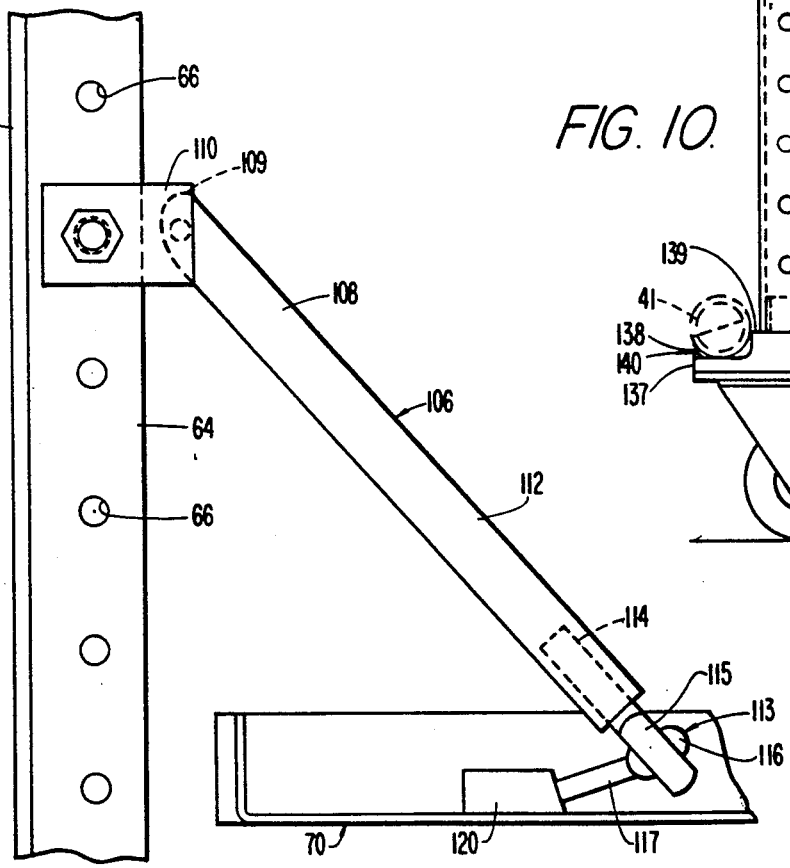
FIG. 8 is an enlarged elevational view of the adjustable deck section brace attached to the center T-bar section and deck section.
Figure 9:
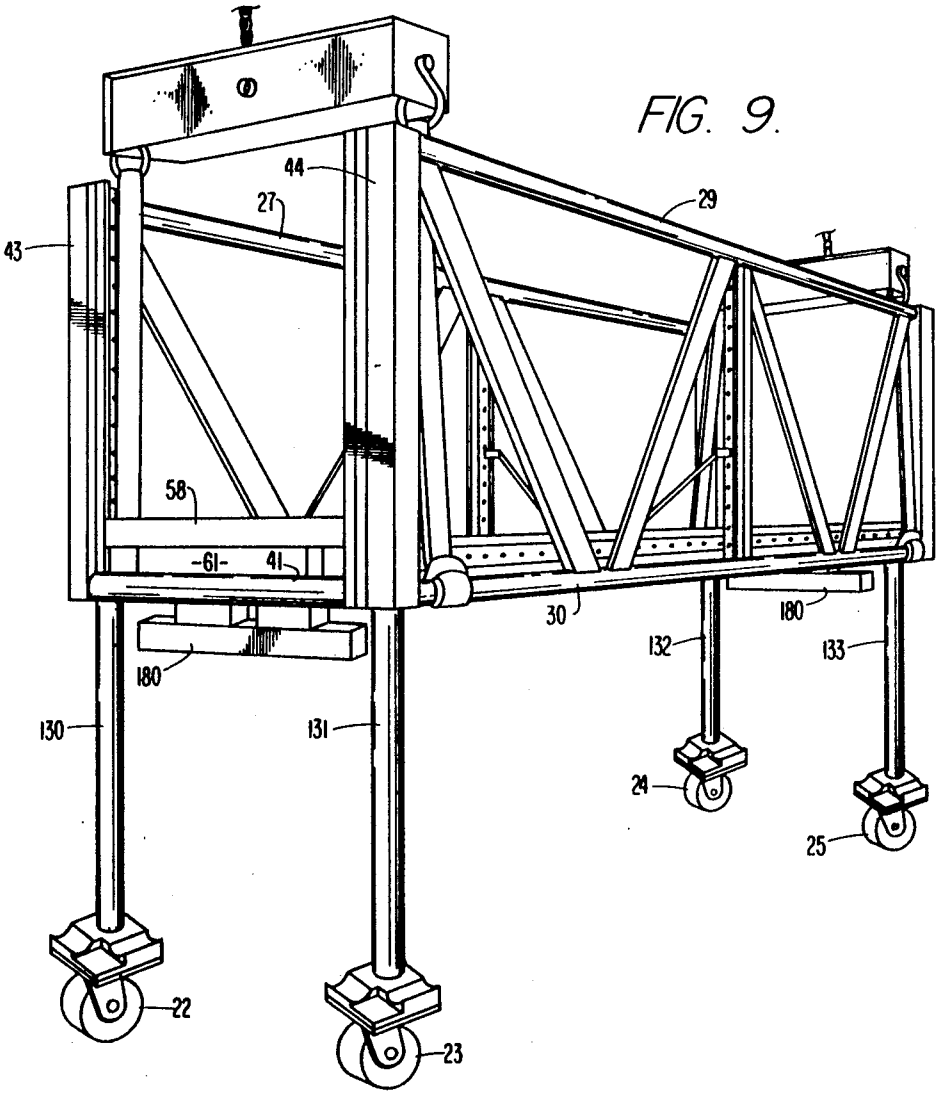
FIG. 9 is a perspective view of the preferred embodiment, with the deck fully lowered and the legs fully extended.

As shown in FIGS. 3, 6 and 8, opposed diagonal brace assemblies 106 and 107 are provided to stiffen the truss 10 at about its midpoint. Each of the assemblies 106 and 107 includes a tubular brace such as brace 108 pivotally attached at a first end portion 109 to a block-shaped guide 110 having a slot and a hole, and pivotally attached at a second end portion 112 to a pivot assembly 113. The pivot assembly 113 includes a rod 114 having a socket-type terminus 115 in which is trapped a ball 116 attached to an arm 117. The arm is threaded into a block, such as block 120, welded to one of the deck sections, such as the deck section 70. The guide 110 is attached to the central flanges, such as the flange 64 of the bar beam 31, by a spring-loaded plunger 121 through a pair of holes, hole 66 in the beam flange 64 and the hole in the block guide 110. The block guide 110, plunger 121 and beam flange 64 look and operate like the guides 90, 98, beam flanges 53 and 64, and respective plungers already described. The brace assemblies 106 and 107 each generally form the hypotenuse of a right triangle in a plane generally vertical to and generally bisecting the deck 20, as shown in FIGS. 3, 6 and 8. When the truss system 10 is hoisted, the brace assemblies 106 and 107 serve to stiffen the truss system especially against lateral movement of the lateral members 12, 14.

Figure 11:
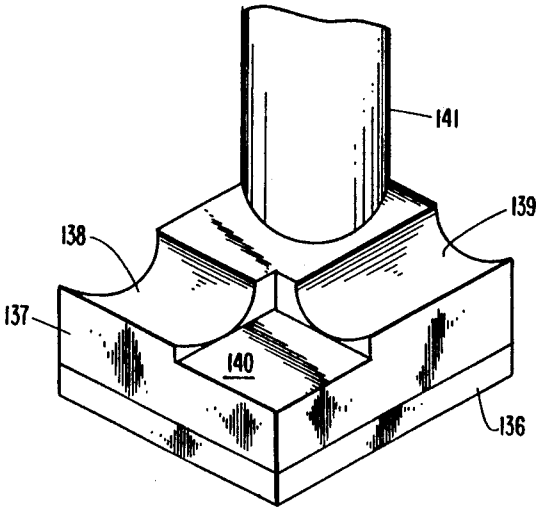
FIG. 11 is a perspective view of the support pad which receives the orthogonal corners formed by the junctions of the lateral and end member lower beams.

Referring to FIGS. 6, 7, 9 and 10, attached to each mounting plate 84, 85, 86, 87 is a cylindrical collar 123, 124, 125, 126, respectively, wherein is slidably disposed a tubular caster leg 130, 131, 132, 133. Each leg has a series of vertically spaced holes 134, the leg terminating downwardly in a mounting plate 136 to receive the caster connected to its lower surface and a support pad 137 attached to its upper surface. As best shown in FIG. 11, the support pad 137 has an upper surface divided into four portions, a pair of orthogonally disposed concave surfaces 138, 139, a flat base portion 140 and an attachment portion 141. The attachment portion 141 has an upstanding shank 142 and receives the lower end of the leg in a telescope arrangement. The two concave surfaces 138, 139 are adapted to abut the tubular beams from the lateral and end members, such as beams 41 and 28, respectively. The flat base portion 140 abuts the vertically disposed beams such as beam 43. When the truss system is in its transportation mode and is being moved on its casters, any forces on the casters are transmitted to the frame beams of the truss and are not carried by the legs alone. The casters are commercially available from Albion Industries of Albion, Mich.

Returning to FIG. 7, the ease of assembly can be appreciated. Attached to each collar, such as the collar 123, is a block, such as the block 128, and the collar 123 and the block 128 having aligned holes 147 and 148, respectively, therethrough. The relative vertical position of the leg is adjusted by aligning One of its holes 134 with the holes 147, 148 and by mounting a spring-loaded plunger 149 in the hole 148 and having the plunger enter the holes 147 and 134. The plunger 149 is a fully retractable stubby spring plunger available commercially from the Vlier Corporation. As before, a locking means is achieved simply by the placement of a plunger in aligned holes. This allows for quick adjustment and quick assembly and disassembly of the entire truss system.

Figure 12:
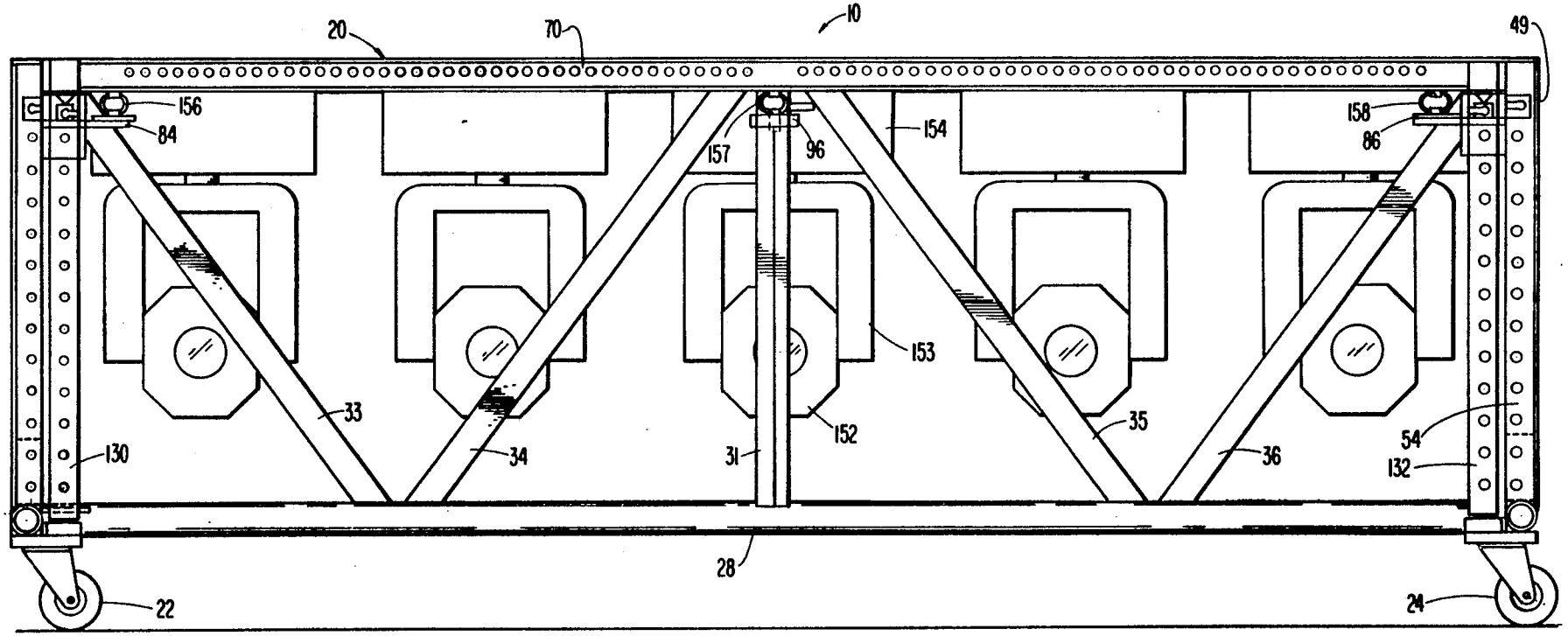
FIG. 12 is a partial cross-section elevational view of the preferred embodiment with the deck fully raised, lighting fixtures suspended therefrom, and the coiled cable shock mounts isolating the deck sections from the end-plates and transverse bar beam in place.

FIG. 12 shows a view of the truss system 10 when the deck 20 is fully raised and the caster legs are fully retracted. This is the system's position used during storage and transportation; and transportation is usually by truck. In the truck, the system may be stood upright so that the system is resting on one of its end members 16, 18. A plurality of components, such as stage lights 152 with yokes, such as yokes 153, are suspended from the deck by means of Corresponding attachments, such as attachments 154. Also illustrated are a plurality of coiled cable shocks 156, 157 and 158, interposed between the mounting plates, such as plates 84 and 86, and the deck sections, such as section 70, and between the transverse beam 96 and the deck sections, thereby cushioning the deck sections from shock and vibration.

In the position shown in FIG. 12, the lights are within the frame and are protected by the lateral and end members while the shock mounts partially isolate the lights from vibration and shock.

Figure 13:
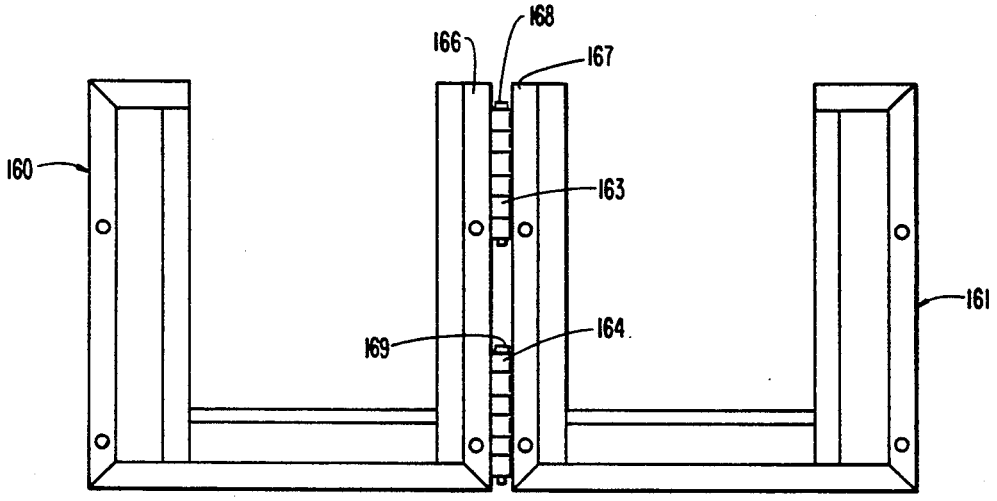
FIG. 13 shows an end elevational view of two hinged interfaces.
Figure 14:
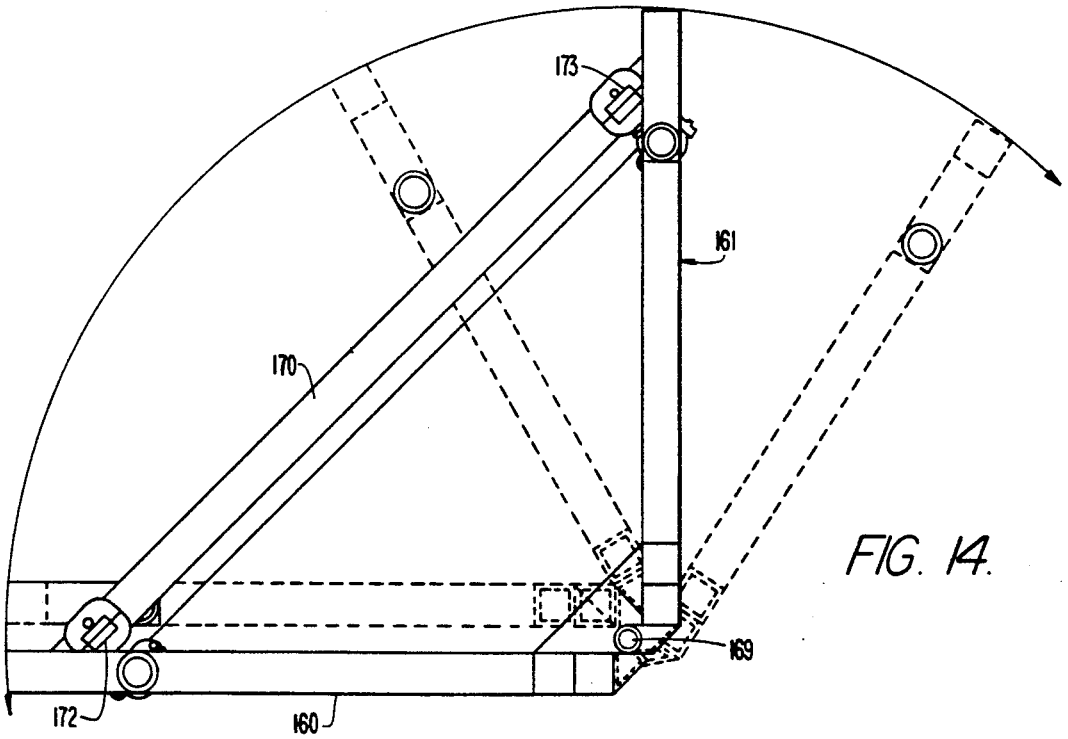
FIG. 14 is a top plan view of the extendable brace for maintaining the angle between two units.

The truss system may be linked rectilinearly or at any angle. As shown in FIGS. 13 and 14, hinge means such as linking brackets 160, 161 generally conforming to the U-shape of end members 16 and 18 and having hinges 163, 164 disposed along adjacent vertical beams 166, 167 can be attached to either or both end members of the truss unit. The linking brackets may be attached to adjacent truss units by bolts. Rods 168, 169 inserted through the hinge holes complete the hinges. The angle at the vertex of the hinges is maintained by an extendable brace 170 whose ends terminate in clamps 192 and 173 which attach, respectively, to the brackets 160, 161. Clamps are available from Upright Scaffold, Inc. of Berkeley, Calif. Thus, the adjacent truss units may be placed at any preselected angle one to the other.

Figure 19:
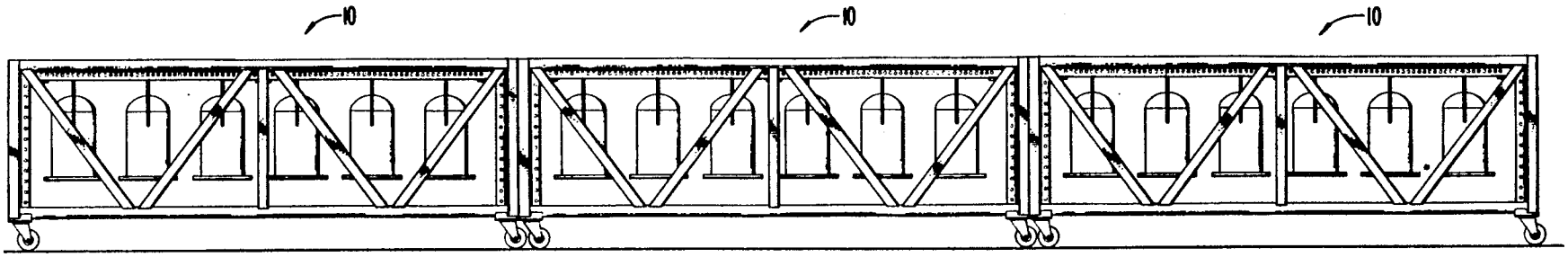
FIG. 19 shows the truss units of FIG. 18 bolted together.

If the units are to be attached directly one to another, bolts, such as bolt 174 in FIG. 2, may be placed through holes such as holes 175 and 178 and tightened with nuts to secure each unit in a linear disposition, as shown in FIG. 19.

Figure 15:
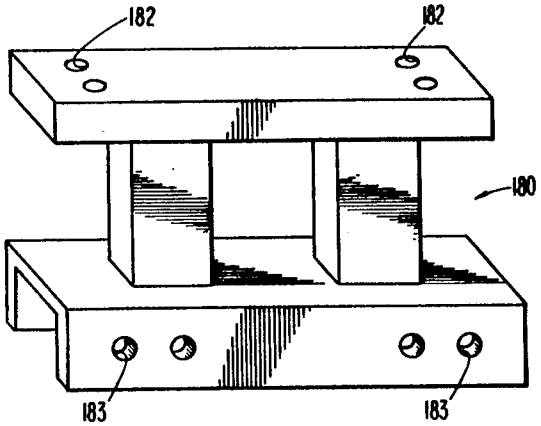
FIG. 15 is a perspective view of the cradle mounting bracket.
Figure 16:
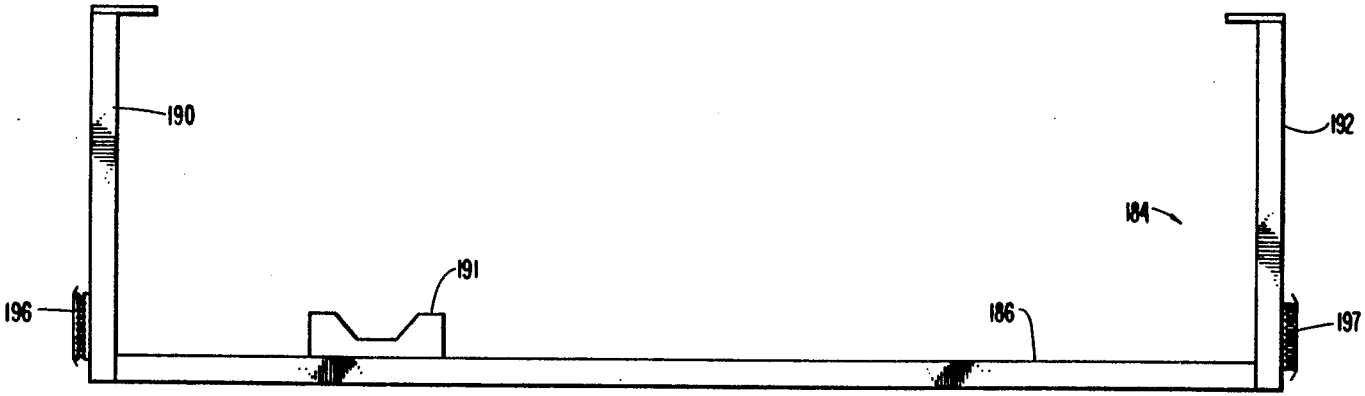
FIG. 16 is an elevational view of the U-shaped cradle.

Referring to FIGS. 15 and 16, a cradle mounting bracket 180 with pairs of bolt-holes 182, 183 is attached to each tubular beam 82, 83 of the deck prior to transporting or storing the truss system. A pair of U-shaped cradles 184 each including a horizontal beam 186 and a pair of vertical beams 190, 192 are attached to the brackets 180 by means of bolts through bolt holes in the brackets or by mating latches (not shown). Additional mounting elements, such as formed block 191 for nesting the components may be connected to the cradles 184. The cradles 184 serve to protect suspended components during transport or storage by restraining movement of the components. The brackets 180 and the cradles 184 are removed prior to operationally deploying the truss system. The cradle beams 186, 190 and 192 are dimensioned so as to be closely received between the box-shaped members 61, 62. A plurality of coiled cable shocks 196, 197 are interposed between the cradles 184 and the box-shaped members 61, 62 to further isolate suspended components from shock and vibration.

Figure 17:
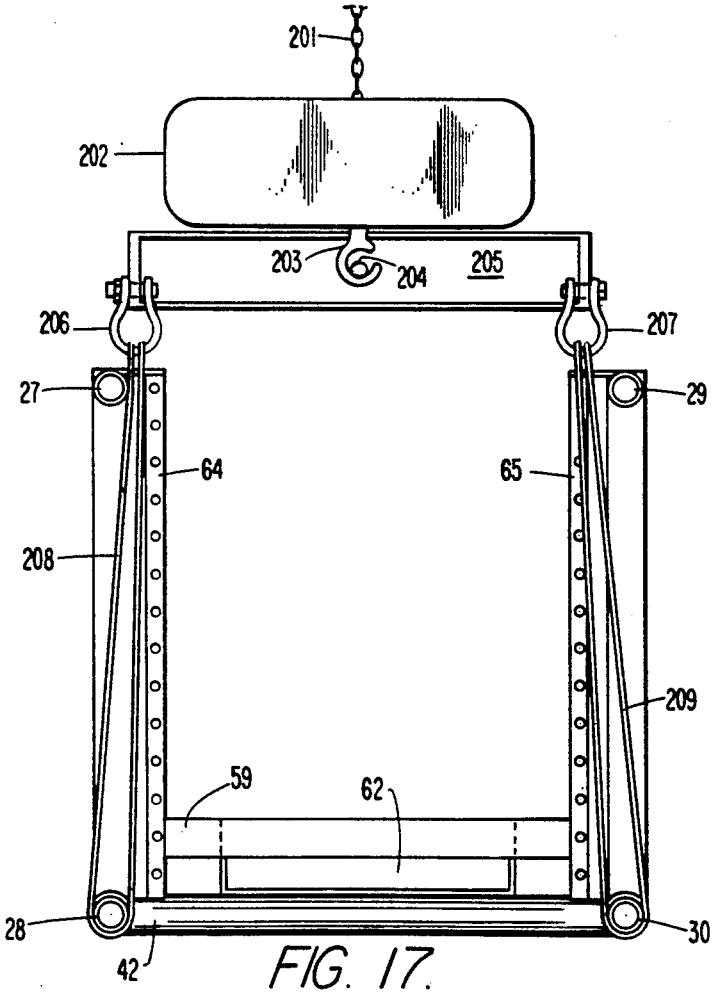
FIG. 17 is a partial cross-section elevational view of a hoist, lift bar, and end-member.

The truss system is moveable between its storage and transportation modes, as already described, to the hoisted position in which the components are exposed and the truss system is suspended above a stage or other floor surface. Referring now to FIG. 17, during operation the truss unit may be raised to a desired height by a pair of chain hoisted cables, such as cable 210, attached to the lateral members 16 and 18 by means of a housing 202 terminating in a hook 203 attached to a pin 204 in a lift bar 205 formed from a pair of channel members, to which are attached a pair of shackle bolts 206, 207. A pair of span cables 208, 209 pass, respectively, through the shackle bolts 206, 207 and around the longitudinal beams 28 and 30.

The truss system disclosed here may be quickly assembled and disassembled so that labor costs are minimized at venue sites. In addition, the system allows the deck to be adjusted to a preselected suitable vertical level so as to accommodate differences among venue sites.

Figure 18:
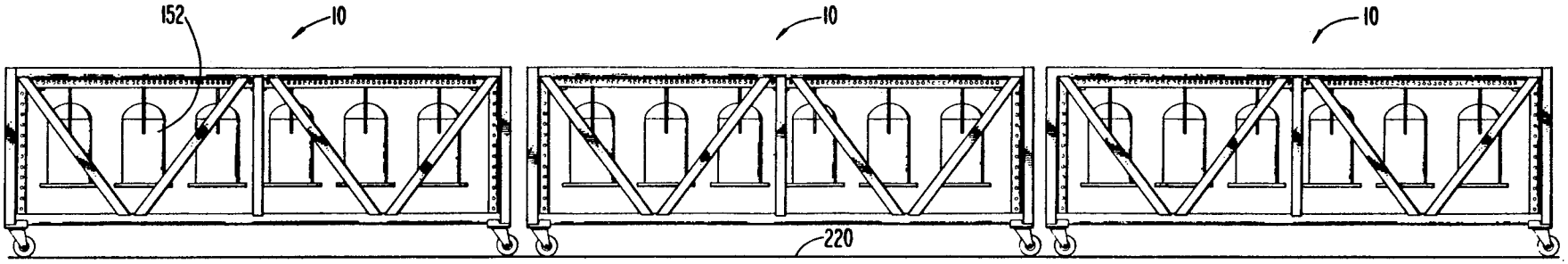
FIG. 18 shows a three-unit truss system aligned on stage.
Figure 20:
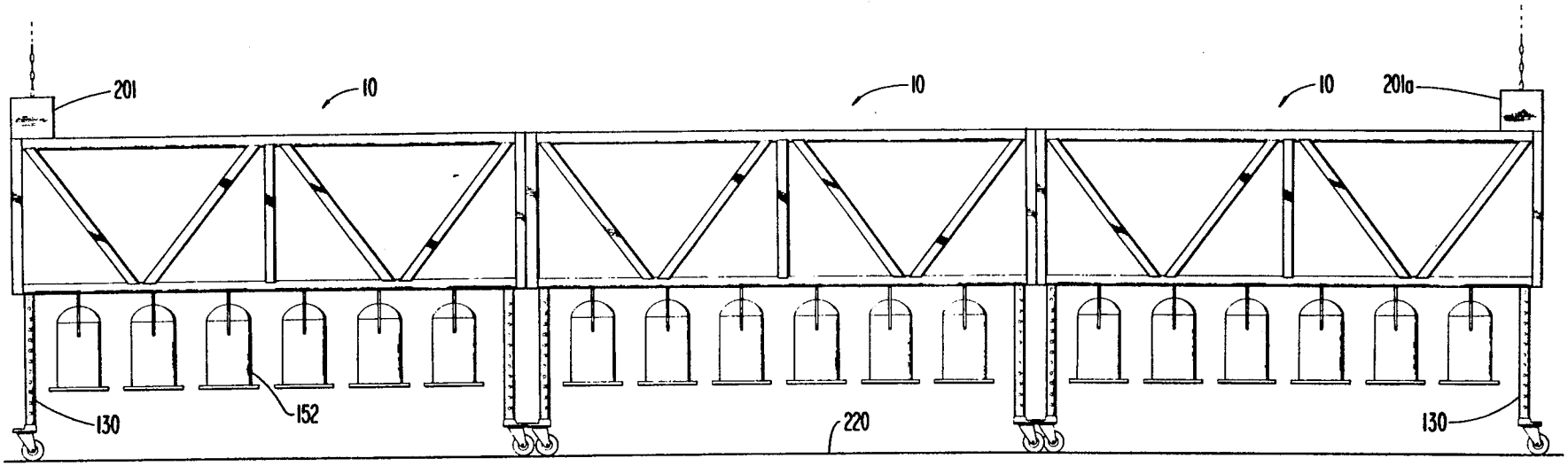
FIG. 20 shows the truss units of FIG. 18 partially raised, and where the decks have been vertically displaced and the legs are extended.
Figure 21:
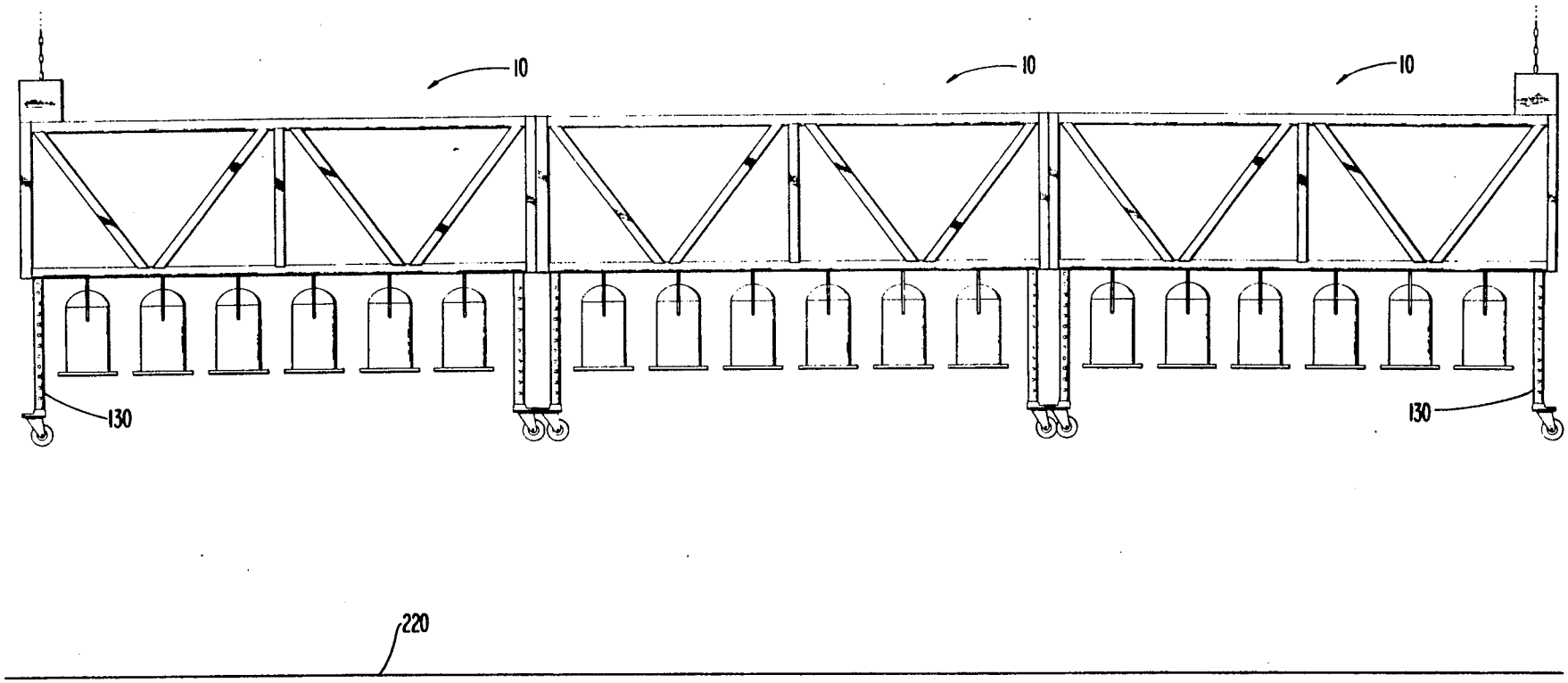
FIG. 21 shows the three-unit configuration of FIG. 18 hoisted off the stage.
Figure 22:
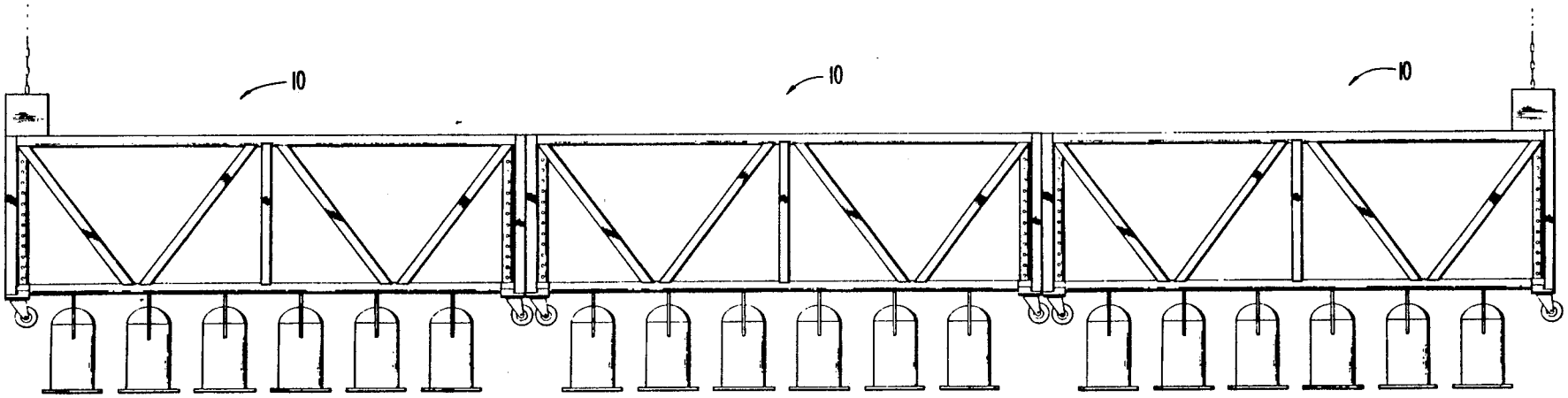
FIG. 22 shows the three-unit configuration of FIG. 18 operationally deployed With legs retracted.

In operation and as shown in FIGS. 18, 19, 20, 21 and 22, connecting and operationally deploying a multi-unit truss system entails a sequence of steps. First, the truss units are transported, usually on end. They are pivoted to their casters and wheeled off the truck onto a stage 220 and aligned in a preselected position before being connected. FIG. 18 schematically shows the alignment of units in their transportation mode where components are suspended from the deck, such as the stage lights 152, and are enclosed and protected. The cradles shown in FIG. 16 have already been removed. The deck is in the fully raised position and the caster legs are fully retracted. Second, as shown in FIG. 19, the units are bolted together in a linear arrangement. As many units as necessary can be attached in a linear fashion or at angles, depending upon the geometry desired. Third, as shown in FIG. 20, the hoists **201, 201*a* are connected and selected plungers are retracted to allow the lateral and end members to be raised to working height above the stage or ground, about waist high. It is noted that while the legs are still on the stage floor, suspended components such as the stage lights 152 are exposed and an access way is created on the deck between the raised lateral members. Workers standing on the stage floor 220 can now access the suspended components and adjust or repair them as needed. After the components have been adjusted, the brace assemblies are set. Fourth, in FIG. 21, the multi-unit structure is hoisted above the stage floor a short distance while the legs remain fully extended. The legs are retracted, and cables and auxiliary equipment are attached. Fifth, as shown in FIG. 22**, the truss units are fully lifted to a preselected operational height.

It should be noted that little clearance is needed for this operation, unlike some prior art devices where lateral members must be rotated into position and require a large clearance area.

After an engagement is completed, the above steps are generally reversed and the units are quickly and easily contracted and disassembled for loading back into the truck or other vehicle for shipment to the next venue. Assembly and disassembly ca be accomplished quickly and efficiently with a minimum of labor, thereby enhancing the value of the truss system.

What is claimed is:

1. A truss system comprising:

a platform deck;

opposed first and second lateral members;

opposed first and second end members;

means connecting said platform deck to said lateral and end members for guiding said platform in a vertical direction relative to said lateral and end members, said guiding means includes a block connected to said deck and a support member connected to said lateral and end members, whereby said support member and said block are adapted to slide relative to one another; and means for locking said deck in a preselected vertical location relative to said lateral and end members, whereby components suspended from said deck are in a protected position when said deck is in an upper vertical location and are in an operating position when said deck is in a lower vertical location.

2. The truss system of claim 1, including hinge means connected to said end member for connecting adjacent truss systems and displacing them at an angle one from the other.

3. The truss system of claim 1, including:

a plurality of casters; and a support pad connected to each of said casters with an upper surface having a first portion for abutting said lateral member, a second portion for abutting said end member, a third portion for abutting said end member, and a fourth portion for connecting to a leg.

4. The truss system of claim 3, including:

a plurality of legs moveable relative to said lateral and end members, each leg connected to a caster, and means for locking the locations of said legs.

5. A truss system comprising:

a platform deck;

opposed first and second lateral members;

opposed first and second end members;

means connecting said platform deck to said lateral and end members for guiding said platform in a vertical direction relative to said lateral and end members;

means for locking said deck in a preselected vertical location relative to said lateral and end members, whereby components suspended from said deck are in a protected position when said deck is in an upper vertical location and are in an operating position when said deck is in a lower vertical location;

a plurality of legs moveable relative to said lateral and end members; and means for locking the location of said legs.

6. The truss system of claim 5, wherein said guiding means includes a block connected to said deck and a support member connected to said lateral and end members, whereby said support member and said block are adapted to slide relative to one another.

7. The truss system of claim 5, wherein:

said guiding means includes a block connected to said deck and a support member connected to said lateral and end members, whereby said support member and said block are adapted to slide relative to one another; and said locking means comprises a plunger and aligned holes in said block and said support member.

8. The truss system of claim 5, including support members attached to said deck, wherein said guiding means includes:

a plurality of blocks, each connected to a support member;

a plurality of support members connected to said lateral and end members; and said locking means includes a plurality of plungers, each plunger adapted to be received in aligned holes in one of said blocks and a corresponding one of said end support members; and including a plurality of collars, each connected to a support member, wherein one of said legs slides relative thereto; and a plurality of plungers, each plunger adapted to be received in aligned holes in one of said collars and a corresponding one of said legs.

9. A truss system comprising:

opposed first and second lateral members;

opposed first and second end members attached to said first and second lateral members and forming a frame;

a platform deck connected to said end members;

first guiding means connected to said deck and said frame for altering the position of said deck with respect to said lateral and end members;

first locking means connected to first sliding means for fastening said deck to said frame;

a plurality of legs connected to said frame;

second guiding means connected to said deck for allowing the alteration of the position of said legs with respect to said frame; and second locking means connected to said sliding means for maintaining the position of said legs with respect to said frame.

10. The truss system of claim 9, wherein said deck comprises at least one planar section having a multiplicity of holes.

11. The truss system of claim 9, wherein said first guiding means comprises a plurality of blocks connected to said deck, wherein each block slides relative to the central flange of a corresponding T-shaped beam attached to said frame.

12. The truss system of claim 11, wherein said first locking means for fastening said deck to said frame comprises:

a plurality of plungers, each plunger passing through a hole in one of said blocks and an aligned hole in one of said beams.

13. The truss system of claim 9, including opposed first and second pivotable braces spanning said frame and said deck, and connected thereto.

14. The truss system of claim 14, wherein said second guiding means comprises a plurality of collars, each collar connected to said deck, whereby said legs are slidably disposed within said collars.

15. The truss system of claim 14, wherein said second locking means to fix the length of the extended portion of said leg with respect to said frame comprises plurality of plungers, each plunger passing through a hole in one of said collars and through an aligned hole in one of said legs.

16. The truss system of claim 9, including casters attached to said legs; and means for transmitting shock and vibration experienced by said casters comprising a plurality of caster mounting plates, the upper surface of each plate having a pair of orthogonal concave recesses.

17. The truss system of claim 9, including means for partially isolating said deck from shock and vibration experienced by said frame comprising a plurality of coiled cable shocks interposed between said frame and said deck.

18. The truss system of claim 9, wherein:

said first guiding means comprises a plurality of blocks connected to said deck, each said block sliding relative to the central flange of a corresponding T-shaped beam attached to said frame;

said first locking means comprise a plurality of plungers, each plunger passing through a hole in one of said blocks and an aligned hole in one of said beams;

said second guiding means comprises a plurality of collars, each collar connected to said deck, whereby said legs are slidably disposed within said collars; and said second locking means comprises a plurality of plungers, each plunger passing through a hole in one of said collars and through an aligned hole in one of said legs.

19. The truss system of claim 18, comprising:

casters attached to said legs;

means for transmitting shock and vibration experienced by said casters;

means for partially isolating said deck from shock and vibration experienced by said frame;

hinge means connected to said end member for connecting adjacent truss units and displacing them at an angle one from the other; and opposed first and second pivotable braces spanning said frame and said deck, and connected thereto.

20. The truss system of claim 19, wherein:

said means for transmitting shook and vibration experienced by said casters comprises a plurality of caster mounting plates, the upper surface of each plate having a pair of orthogonal concave recesses; and said means for partially isolating said deck from shock and vibration comprises a plurality of coiled cable shocks interposed between said frame and said deck.

21. A truss system comprising:

first and second lateral numbers;

a mounting element for allowing the attachment of components to the truss system;

a guiding and connecting element connected to the mounting element and to the lateral members disposed to allow vertical sliding movement of the lateral members upwardly and downwardly relative to the mounting element; and a locking element connected to the guiding and connecting element for locking and releasing the guiding and connecting element whereby the relative vertical position between the mounting element and the lateral members may be altered and fixed as desired.

22. The truss system of claim 21 including:

a plurality of legs connected to the mounting element and movable relative to said lateral members and means for locking said legs in a preselected location.

* * * * *